US008613974B2

(12) United States Patent
Keita

(10) Patent No.: US 8,613,974 B2
(45) Date of Patent: Dec. 24, 2013

(54) METHOD FOR PREPARING AN ELECTRODE FOR PRODUCING HYDROGEN

(75) Inventor: Bineta Keita, Fontenay aux Roses (FR)

(73) Assignee: Centre National de la Recherche Scientifique, Paris (FR)

( * ) Notice: Subject to any disclaimer, the term of this patent is extended or adjusted under 35 U.S.C. 154(b) by 413 days.

(21) Appl. No.: 13/127,083

(22) PCT Filed: Nov. 3, 2009

(86) PCT No.: PCT/FR2009/052120

§ 371 (c)(1),
(2), (4) Date: May 12, 2011

(87) PCT Pub. No.: WO2010/052421

PCT Pub. Date: May 14, 2010

(65) Prior Publication Data

US 2011/0212259 A1 Sep. 1, 2011

(30) Foreign Application Priority Data

Nov. 5, 2008 (FR) ..... 08 06168

(51) Int. Cl.
*B05D 5/12* (2006.01)

(52) U.S. Cl.
USPC ..... 427/115; 429/535

(58) Field of Classification Search
USPC ..... 427/115; 429/535, 524, 523, 521
See application file for complete search history.

(56) References Cited

U.S. PATENT DOCUMENTS

| | | | | |
|---|---|---|---|---|
| 2006/0141334 | A1 | 6/2006 | Nakajima | |
| 2008/0102338 | A1 * | 5/2008 | Son et al. | 429/30 |
| 2009/0035615 | A1 * | 2/2009 | Urgeghe et al. | 429/13 |
| 2010/0098877 | A1 * | 4/2010 | Cooper et al. | 427/551 |

FOREIGN PATENT DOCUMENTS

FR 2573779 11/1984

OTHER PUBLICATIONS

Search Report Dated Jan. 7, 2010.
New Oxometalate-Based Materials for Catalysis and Electrocatalysis, vol. 22, issues 1-2, 1989.

* cited by examiner

*Primary Examiner* — Michael Cleveland
*Assistant Examiner* — Tabassom Tadayyon Eslami
(74) *Attorney, Agent, or Firm* — Sofer & Haroun, LLP

(57) ABSTRACT

A method for preparing an electrode, includes the steps of preparing a suspension of a polyoxometalate and a material conferring electronic conductivity and comprising positive charges in a solvent; depositing the suspension obtained in the first step on a carbon medium; drying the suspension deposited in previous step, and applying a binder to the suspension dried in previous step to obtain an electrode.

22 Claims, 2 Drawing Sheets

METHOD FOR PREPARING AN ELECTRODE FOR PRODUCING HYDROGEN

RELATED APPLICATIONS

This application is a National Phase application of PCT/FR2009/052120, filed on Nov. 3, 2009, which in turn claims the benefit of priority from French Patent Application No. 08 06168, filed on Nov. 5, 2008, the entirety of which is incorporated herein by reference.

BACKGROUND

1. Field of the Invention

The present invention relates to a process for the preparation of an electrode. It typically but not exclusively applies to the fields of the electrodes for the production of hydrogen by the electrochemical route.

2. Description of Related Art

Many research studies are currently being carried out with the aim of finding products which can be substituted for the noble metals used as electrode in the production of hydrogen. However, the existing methods are very expensive since they use precious metals for the electrode materials, in particular platinum, which is one of the best catalysts for the electrochemical production of hydrogen.

FR 2 573 779 describes a process for the preparation of an activated electrode for the production of hydrogen, said electrode being obtained by bringing an electrode composed of a glassy carbon into contact in an acidic medium with a dilute aqueous solution of a polyoxometalate, such as, for example, $SiW_{12}O_{40}H_4$, and by then bringing said electrode to a cathode potential sufficient to produce a reduced form of the polyoxometalate. This process employs a relatively inexpensive material but is carried out with a negative potential which requires a large amount of electrical energy. Furthermore, this process requires exclusive use of highly acidic media (pH in the vicinity of 0) and it is not possible to optimize the thickness of the catalyst film obtained by this method, the efficiency of the catalyst depending on said thickness.

Furthermore, patent applications US 2006/0141334 describes a catalytic electrode for the adsorption of carbon monoxide CO or the oxidation of methanol. The electrode comprises in particular a partial salt of a solid heteropolyacid doped with a noble metal, such as, for example, with Pt or Ru, or with a transition metal and having a molecular weight ranging from 800 to 10000. This polyacid can be applied to the surface of a carbon electrode, in the form of a mixture with an organic or inorganic binder. In example 1, a powder composed of a mixture of a heteropolyacid of formula $Na_5H_3[PtW_6O_{24}].xH_2O$ comilled with acetylene black is dispersed in a 5% solution of Nafion in a solvent, the nature of which is not specified. The mixture is subsequently applied to a glassy carbon electrode and then dried at ambient temperature. The electrode thus obtained can subsequently be used for the oxidation of methanol. However, such an electrode is not active with regard to the reduction of protons to give dihydrogen. This is because, when this electrode is tested in cyclic voltammetry (used to test the activity of all the electrodes with regard to their ability to reduce protons), only the waves characteristic of polyoxometalates are observed (see, for example, Bineta Keita and Louis Nadjo, Materials Chemistry and Physics, 1989, 22, 77-79). patent applications US 2006/0141334 furthermore does not envisage the use of electrodes of this type in the production of hydrogen by the electrochemical route.

OBJECTS AND SUMMARY

The aim of the present invention is to overcome the disadvantages of the techniques of the prior art by providing in particular a process for the preparation of an electrode using relatively inexpensive materials, said electrode using relatively little electrical energy while having a performance comparable to that of a platinum electrode.

A subject matter of the present invention is a process for the preparation of an electrode comprising the stages consisting in:

i) preparing a suspension in a solvent of a polyoxometalate and of a material conferring an electronic conductivity and comprising positive charges, ii) depositing the suspension obtained in stage i on a carbon support, it being possible for said support to be in the form of bulk carbon or of thin layers of carbon, iii) drying the suspension deposited in stage ii, and iv) applying a binder to the dried suspension of stage iii in order to obtain an electrode.

The electrode according to the invention makes it possible to obtain pure hydrogen without an additional purification stage.

The polyoxometalate is composed of a cation and a polyanion.

The polyanion can be represented by the formula $[M_mO_y]^{p-}$ or the formula $[X_xM_mO_y]^{q-}$, in which M is a transition metal, preferably chosen from W, Mo, V, Nb, Ta, Zn or a mixture of these metals; X is a transition metal or a nonmetallic element preferably chosen from P, As, Sb, Bi, Si, Ge, Se and Te; and m, x, y, p and q are integers greater than or equal to 1.

The cation is chosen from $H^+$, $NH_4^+$, alkali metal cations, alkaline earth metal cations and transition metal cations. The cation is preferably chosen from $H^+$, $NH_4^+$, $Li^+$, $Na^+$, $K^+$, $Rb^+$, $Cs^+$, $Mg^{2+}$, $Ca^{2+}$, $Mn^{2+}$, $Co^{2+}$, $Ni^{2+}$, $Cu^{2+}$ and $Zn^{2+}$.

Mention may be made, as examples of polyoxometalates, of $H_3PW_{12}O_{40}$ (PW); $H_4SiW_{12}O_{40}$ (SiW); $(NH_4)_6H_2W_{12}O_{40}$ ($H_2W$); $K_7P_2W_{17}O_{61}V$; $K_7P_2W_{17}O_{61}Fe$; $K_{10}P_2W_{17}O_{61}$; $K_8P_2W_{17}O_{61}M^1$ with $M^1$ chosen from $Mg^{2+}$, $Ca^{2+}$, $Mn^{2+}$, $Co^{2+}$, $Ni^{2+}$, $Cu^{2+}$ and $Zn^{2+}$; $K_5SiW_{11}O_{39}F$; $K_8SiW_{11}O_{39}$; $K_6SiW_{11}O_{39}M^2$ with $M^2$ chosen from $Mn^{2+}$, $Co^{2+}$, $Ni^{2+}$, $Cu^{2+}$ and $Zn^{2+}$; $K_4PW_{11}O_{39}Fe$; $K_7PW_{11}O_{39}$; $K_5PW_{11}O_{39}M^3$ with $M^3$ chosen from $Mn^{2+}$, $Co^{2+}$, $Ni^{2+}$, $Cu^{2+}$ and $Zn^{2+}$; $K_9P_2W_{15}O_{62}V_3$ and $K_8Nb_6O_{19}$.

In a first embodiment, the material conferring an electronic conductivity and comprising positive charges is a carbonaceous material prepared prior to stage i by heat treatment of a carbon, the heat treatment preferably being carried out at a temperature of at least 900° C.

More particularly, a carbon which is in the form of carbon black, of carbon nanotubes, of graphite, of glassy carbon, of carbon felt or of carbon nanoparticles is subjected to the heat treatment.

In an additional stage, prior to stage i, the carbon thus heat-treated can be milled. Preferably, the polyoxometalate can be comilled with the heat-treated carbon.

In this first embodiment, the solvent of stage i can be an organic solvent, preferably a solvent chosen from isopropanol, ethanol and dimethylformamide.

Finally, according to a specific implementational example, the content by weight of polyoxometalate is at least equal to the content by weight of carbon in the suspension obtained in stage i.

Still according to this first embodiment, that is to say when the material conferring an electronic conductivity is a carbonaceous material, the content by volume of the binder is at least 75% in the suspension obtained in stage i.

In a second embodiment, the material, conferring an electronic conductivity and comprising positive charges is a metal oxide carrying positive charges.

In that which follows:

"metal oxide" denotes a metal oxide as is not carrying positive charges; and

"metal oxide carrying positive charges" denotes a metal oxide comprising positive charges at its surface.

The metal oxide used as material conferring an electronic conductivity can be chosen from oxides which are stable in an aqueous medium and which have a good electrical conductivity. It is advantageously chosen from partially oxidized titanium, titanium oxide $TiO_2$ in powder or bulk form, indium oxide doped with tin (ITO) or tin dioxide $SnO_2$.

According to a preferred implementational example, the metal oxide and the polyoxometalate are comilled prior to stage i.

The content by weight of polyoxometalate of stage i can advantageously be at least 25% greater than the content by weight of the metal oxide used for the preparation of the material conferring an electronic conductivity and comprising positive charges.

Still according to this second embodiment, that is to say when the material conferring an electronic conductivity is a metal oxide, the content by volume of the binder can advantageously be at least 25% and at most 50% in the suspension obtained in stage i.

In a first alternative form of the second embodiment, the metal oxide carrying positive charges is obtained in situ, during the suspending of the polyoxometalate and of the metal oxide in a solvent. In this case, the solvent, at stage i is an acidic aqueous solution with a pH of less than or equal to 5, preferably of less than or equal to 1. Mention may be made, by way of example, as acidic aqueous solution, of an aqueous $HClO_4$ solution.

In a second alternative form of the second embodiment, the metal oxide carrying positive charges is obtained prior to stage i. In this case, the metal oxide is coated with a polymer comprising positive charges before suspending in the solvent according to stage i.

By way of example, the polymer comprising positive charges can be chosen from polyvinylpyridine, polyaniline, polythiophene, polypyrrol and poly(diallyldimethylammonium). The solvent of stage i can be an acidic aqueous solution with a pH of less than or equal to 5, preferably of less than or equal to 2. Mention may be made, as example, as acidic aqueous solution, of an acidic aqueous $H_2SO_4$ solution.

In the preparation process according to the invention, the binder used in stage iv can typically be an organic binder, preferably a polymeric binder, which makes it possible to confer mechanical properties on the electrode.

When the polyoxometalate is stable in an acidic medium, the binder is a fluoropolymer, preferably chosen from hydrogenated sulfonated tetrafluoroethylene copolymers (e.g., hydrogenated Nafion®, sold by Aldrich), and any polymer which can act as proton-exchange membrane.

The polyoxometalates stable in an acidic medium are, for example, $H_3PW_{12}O_{40}$ (PW), $H_4SiW_{12}O_{40}$ (SiW) or $(NH_4)_6H_2W_{12}O_{40}$ ($H_2W$).

When the polyoxometalate is stable in a neutral or basic medium, the binder can be chosen from nonhydrogenated sulfonated tetrafluoroethylene copolymers (e.g., nonhydrogenated. Nafion®, sold by Aldrich).

The polyoxometalates stable in a neutral medium are, for example, $(NH_4)_6H_2W_{12}O_{40}$ ($H_2w$) $K_7P_2W_{17}O_{61}V$; $K_7P_2W_{17}O_{61}Fe$; $K_{10}P_2W_{17}O_{61}$; $K_8P_2W_{17}O_{61}M^1$ with $M^1$ chosen from $Mg^{2+}$, $Ca^{2+}$, $Mn^{2+}$, $Co^{2+}$, $Ni^{2+}$, $Cu^{2+}$ and $Zn^{2+}$; $K_5SiW_{11}O_{39}Fe$; $K_8SiW_{11}O_{39}$; $K_6SiW_{11}O_{39}M^2$ with $M^2$ chosen from $Mn^{2+}$, $Co^{2+}$, $Ni^{2+}$, $Cu^{2+}$ and $Zn^{2+}$; $K_4PW_{11}O_{39}Fe$; $K_7PW_{11}O_{39}$; or $K_5PW_{11}O_{39}M^3$ with $M^3$ chosen from $Mn^{2+}$, $Co^{2+}$, $Ni^{2+}$, $Cu^{2+}$ and $Zn^{2+}$. The polyoxometalates stable in a basic medium are, for example, $(NH_4)_6H_2W_{12}O_{40}$ ($H_2W$), $K_9P_2W_{15}O_{62}V_3$ or $K_8Nb_6O_{19}$.

The preparation process according to the invention can additionally comprise a stage consisting in immersing the electrode obtained in stage iv in a solution of an inorganic acid, in particular at a pH of less than or equal to 1, in order to desorb the excess polyoxometalate in the electrode.

In the present invention, the suspension of stage i can be produced by any type of technique well known to a person skilled in the art, such as, for example, by the use of stirring by a magnetic bar or of an ultrasound treatment, the latter technique being preferred since the suspension is produced in a shorter period of time.

DETAILED DESCRIPTION

Figure 1:
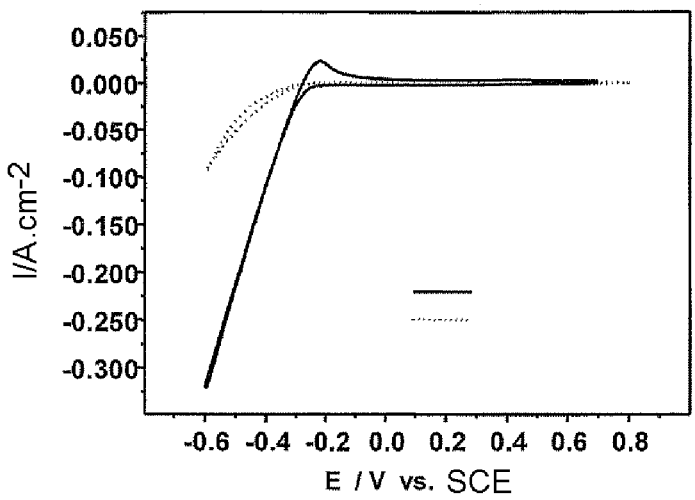
FIG. 1 is a voltammogram of a PW12-carbon material (curve as a solid line) and of an SiW12-carbon material (curve as a dotted line) in accordance with one embodiment.

Other characteristics and advantages of the present invention will become apparent in the light of the examples which will follow, said examples being given by way of illustration and without implied limitation.

Example 1

Preparation of an Electrode According to the Invention by Heat Treatment of a Carbon In this example, the carbon used is carbon powder sold by Cabot under the reference Vulcan XC72 and the polyoxometalates are the products of formulae $H_2PW_{12}O_{40}$ and $H_4SiW_{12}O_{40}$ sold by VWR and the product of formula $(NH_4)_6H_2W_{12}O_{40}$ sold by Fluke.

Preparation of the Material Having Electronic Conductivity and Comprising Positive Charges The carbon powder is heated at 930° C. for 1 hour under a $CO_2$ atmosphere and is then cooled under $CO_2$.

Preparation of the Electrode 2.5 mg of the heat-treated carbon powder and 2.5 mg of polyoxometalates are comilled under dry conditions in a crucible for 30 minutes. The milled mixture thus obtained is suspended in 0.5 ml of isopropanol. This suspension is stirred, using a magnetic bar, for approximately 50 hours.

20 μl of the suspension obtained in the preceding stage are deposited on a 0.3 $cm^2$ bulk carbon electrode and the suspension thus deposited is dried in the air at ambient temperature for approximately 10 min and then at 55° C. for 30 min.

Subsequently, 15 μl of an organic binder (hydrogenated Nafion®, sold by Aldrich) are applied to the surface of the dried suspension. The electrode is subsequently dried in the air and then immersed in an aqueous $H_2SO_4$ solution at pH=0.3 in order to desorb the excess polyoxometalates.

This procedure was employed for each of the three above-mentioned polyoxometalates, namely $H_3PW_{12}O_{40}$, $H_4SiW_{12}O_{40}$ and $(NH_4)_6H_2W_{12}O_{40}$. The electrode obtained is respectively denoted PW12-carbon, SiW12-carbon and H2W12-carbon.

Example 2

Preparation of an Electrode According to the Invention by Suspension of a Metal Oxide in an Acidic Solution The metal oxide used is a titanium oxide $TiO_2$ powder sold by Merck under the Patinal reference and the polyoxometalates are identical to those used in example 1.

2 mg of $TiO_2$ powder are added to 2 ml of an aqueous $HClO_4$ solution at pH=0.7 and then the suspension obtained is treated with ultrasound for 30 min. 10 mg of polyoxometalates are subsequently dispersed in this suspension by stirring with a magnetic bar for approximately 50 h.

The supernatant liquid is withdrawn from the suspension obtained in the preceding stage, 8 microliters of said suspension are deposited on a 0.031 $cm^2$ bulk carbon electrode and then drying is carried out in the air at ambient temperature for approximately 1 hour and then at 65° C. for 10 hours. Subsequently, 2 microliters of hydrogenated Nafion®, sold by Aldrich, acting as binder, are applied at the surface of the dried suspension.

The electrode is subsequently dried in the air and then immersed in an aqueous $H_2SO_4$ solution at pH=0.3 in order to desorb the excess polyoxometalates.

This procedure was repeated for the polyoxometalates $H_3PW_{12}O_{40}$ and $H_4SiW_{12}O_{40}$ and the electrode obtained is respectively denoted PW12-$TiO_2$ and SiW12-$TiO_2$.

Example 3

Preparation of an Electrode According to the Invention by Suspension of a Metal Oxide in an Acidic Solution The metal oxide and the polyoxometalates are identical to those used in example 2.

2 mg of $TiO_2$ powder and 10 mg of polyoxometalate were comilled and then the milled mixture was suspended in 2 ml of $HClO_4$ at pH=0.7. The suspension obtained is treated with ultrasound for 30 minutes.

The supernatant liquid is withdrawn from the suspension obtained in the preceding stage, 8 microliters of said suspension are deposited on a 0.031 $cm^2$ bulk carbon electrode and then drying is carried out in the air at ambient temperature for approximately 1 h and then at 65° C. for 10 hours. Subsequently, 2 μl of hydrogenated Nafion®, sold by Aldrich, acting as binder, are applied at the surface of the dried suspension.

The electrode is subsequently dried in the air and then immersed in an aqueous $H_2SO_4$ solution at pH=0.3 in order to desorb the excess polyoxometalates.

Example 4

Preparation of an Electrode According to the Invention by Coating a Metal Oxide

An electrode was prepared by repeating the procedure of example 2, by using the metal oxide $TiO_2$ coated beforehand with a thin layer of polyvinylpyridine with a thickness varying from 0.1 μm to 0.5 μm and by limiting the duration of the stirring phase to approximately 3 hours instead of 50 hours.

Example 5

Characterization of the Electrodes

The activity and the stability of the electrodes of examples 1 to 4 during the production of hydrogen were evaluated in $H_2SO_4$ at a pH of between 1 and 0 by cyclic voltammetry. All the tests were carried out at ambient temperature.

For the cyclic voltammetry tests, each electrode is subjected to several cycles between +0.7 V and −0.6 V for the carbon powders and between +0.7 V and −0.7 V for the $TiO_2$ powders. The potentials shown were measured with respect to a saturated calomel electrode (SCE) with a scan rate of the potential of between 1 and 100 $mV \cdot s^{-1}$.

FIG. 1 represents the voltammogram of a PW12-carbon material (curve as a solid line) and of an SiW12-carbon material (curve as a dotted line). The intensity of the reduction current, in $A \cdot cm^{-2}$, is given on the ordinate. The potential, in V vs SCE, is given on the abscissa. FIG. 1 shows that the compound PW12-carbon is markedly more effective for the production of hydrogen than the compound SiW12-carbon. The ratio between the intensities of the reduction current is approximately 3.4.

Figure 2:
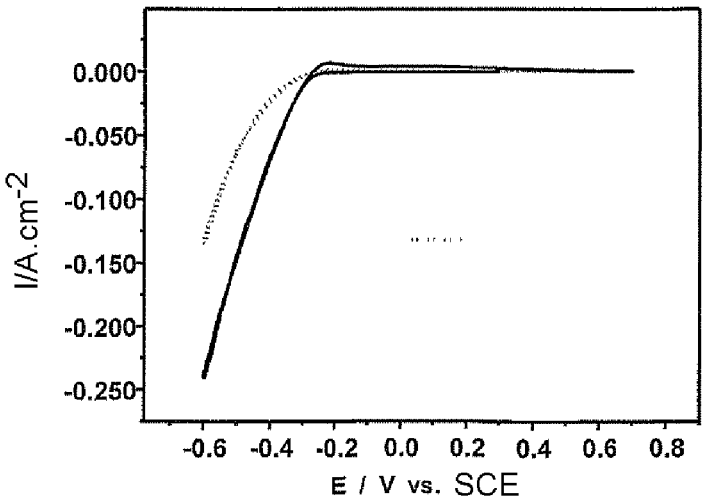
FIG. 2 is a voltammogram of a PW12-$TiO_2$ material (curve as a solid line) and of an SiW12-$TiO_2$ material (curve as a dotted line) in accordance with one embodiment.

FIG. 2 represents the voltammogram of a PW12-$TiO_2$ material (curve as a solid line) and of an SiW12-$TiO_2$ material (curve as a dotted line). The intensity of the reduction current, in $A \cdot cm^{-2}$, is given on the ordinate. The potential, in V vs SCE, is given on the abscissa. FIG. 2 shows that the difference between the effectiveness for the production of hydrogen of the compound PW12-$TiO_2$ and that of the compound SiW12-$TiO_2$ is smaller. The ratio between the intensities of the reduction current is approximately 1.8.

When the polyoxometalate is correctly attached to the carbon or $TiO_2$ powder, cyclic voltammetry shows a current corresponding to the reversible waves characteristic of the polyoxometalate which is proportional to the scan rate of the potential, as predicted by theory. The electrodes prepared according to examples 1 to 4 met this condition. This is because, in examples 1 to 4, the respective curves representing the variation in the current as a function of the scan rate of the potential are straight lines. When the electrodes are brought to potentials which are more negative than those of these first reversible waves of the polyoxometalate, the wave which corresponds to the reduction of the protons to give hydrogen is observed.

The cyclic voltammetry tests have shown that the effectiveness of the electrode according to the invention with regard to the reduction of protons to give hydrogen gradually increases during the first hours.

The term "final state" of the electrode denotes the state starting from which the variations in the characteristics (current and overvoltage for the reduction of the protons) of the electrode are slight. However, the tests carried out with the electrochemical methods have shown that the electrodes according to the invention continue to improve (increase in the current and decrease in the overvoltage of the reduction of the protons) slightly during the various electrochemical treatments (cyclic voltammetry, controlled-potential coulometry (electrolysis), chronocoulometry, chronoamperometry or chronopotentiometry).

In this final state, the electrodes immersed in the sulfuric acid (pH of between 1 and 0) and on which a potential or a current or a cycling is imposed, under the conditions defined above, remain effective with regard to the production of hydrogen.

The quantitative characteristics of the electrodes according to the invention are collated in table 1 below. In addition, table 1 comprises the quantitative characteristics drawn from the literature of metal platinum electrodes, by way of comparison.

TABLE 1

| Electrode | -log $i_0$, in $A \cdot cm^{-2}$ | Slope in mV | Correlation coefficient of the Tafel straight lines |
|---|---|---|---|
| PW12-carbon | 3.27 to 3.03 | 42 to 55 | 0.999 to 0.997 |
| SiW12-carbon | 4.03 to 3.70 | 59 to 94 | 0.997 to 0.996 |
| H2W12-carbon | 3.19 to 3.15 | 56 to 60 | 0.997 to 0.996 |
| PW12-$TiO_2$ | 3.90 to 3.80 | 78 to 85 | 0.997 to 0.996 |
| SiW12-$TiO_2$ | 3.50 to 3.60 | 48 to 50 | 0.998 to 0.996 |
| Platinum | 3.34 to 2.63 | 30 to 120 | Not provided in the literature |

Figure 3:
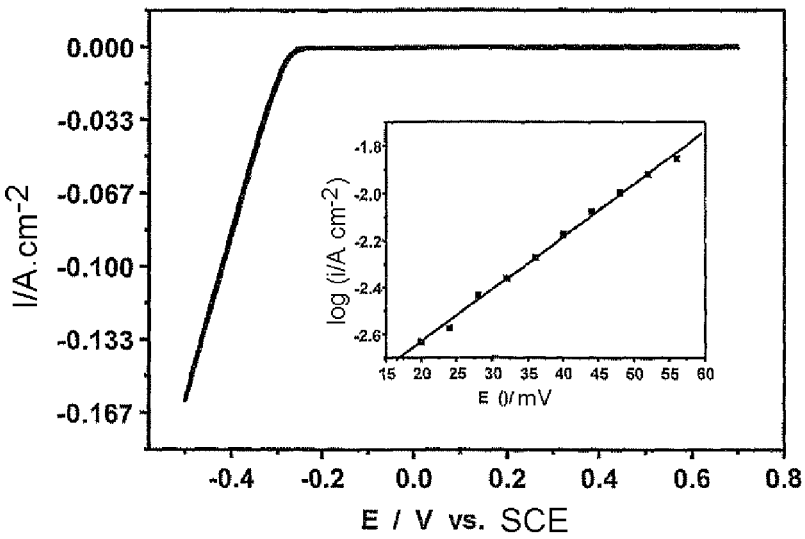
FIG. 3 shows a Tafel straight line and the voltammogram (recorded at 1 $mV \cdot s^{-1}$) which was used for the plotting of this straight line, for the compound PW12-carbon, in accordance with one embodiment.

The data in table 1 are determined from the Tafel straight lines corresponding to the voltammograms recorded at v=1 $mV \cdot s^{-1}$ in $H_2SO_4$ (pH=0). log i and E, i and E being respectively the current and the overvoltage of the reaction for the reduction of protons to give hydrogen, are given on the Tafel straight lines. These currents and overvoltages are measured on a voltammogram recorded at a very low scan rate of the potential. FIG. 3 represents a Tafel straight line and the voltammogram (recorded at 1 $mV \cdot s^{-1}$) which was used for the plotting of this straight line, for the compound. PW12-carbon. The ordinate at the start (log $i_0$, $i_0$ being the exchange current) and the slope of the Tafel straight line are the kinetic parameters which make possible the quantitative comparison of the various electrodes with the platinum electrodes. The log i and E are respectively the current and the overvoltage of the reaction for the reduction of protons to give hydrogen.

The comparison of the values given in table 1 allows it to be concluded that the electrodes according to the present invention exhibit high effectiveness in comparison with the markedly more expensive platinum metal electrodes. Thus, for the production of hydrogen with platinum electrodes or with the materials according to the present invention, the quantitative characteristics (–log $i_0$, slope and correlation coefficient) obtained using the Tafel straight lines have comparable values. In other words, the kinetics of the reaction for the production of hydrogen and the overvoltage necessary with regard to platinum and with regard to the materials of the invention are comparable.

The current density measured in cyclic voltammetry is also an important parameter which increases with the overvoltage and the scan rate of the potential. The current densities found are noteworthy. For example, with PW12-carbon at pH=0, a current density of 0.160 $A \cdot cm^{-2}$ was obtained for an overvoltage of 0.260 V and at a low scan rate of the potential of 1 $mV \cdot s^{-1}$. The current density of 0.120 $A \cdot cm^{-2}$ was obtained with SiW12-$TiO_2$ with a scan rate of the potential of 1 $mV \cdot s^{-1}$ and an overvoltage of 0.360 V. The results described were obtained without any compensation for ohmic drop. This phenomenon is found on looking at the parameters used to record the curves and which are jointly maintained with each curve: the parameter of compensation for ohmic drop is not activated in the absence of compensation for ohmic drop.

Furthermore, the electrodes according to the invention are very stable towards air or in acidic solution. The preparation processes described in the present invention are simple and relatively inexpensive and make it possible to easily attach the polyoxometalate to powders of a material conferring an electronic conductivity. Thus, the electrodes prepared according to the present invention can advantageously be used as substitute for existing platinum electrodes.

What is claimed is:

1. A process for the preparation of an electrode comprising the steps of:

i) preparing a suspension in a solvent of a polyoxometalate and of a material conferring an electronic conductivity and comprising positive charges, ii) depositing the suspension obtained in stage i on a carbon support, iii) drying the suspension deposited in stage ii, and iv) applying a binder to the dried suspension of stage iii in order to obtain an electrode.

2. The process as claimed in claim 1, wherein the polyoxometalate is composed of a cation and a polyanion, the polyanion being represented by the formula $[M_mO_y]^{p-}$ or the formula $[X_xM_mO_y]^{q-}$, in which M is a transition metal, X is a transition metal or a nonmetallic element selected from the group consisting of P, As, Sb, Bi, Si, Ge, Se and Te, and m, x, y, p and q are integers greater than or equal to 1, and the cation selected from the group consisting of $H^+$, $NH_4^+$, alkali metal cations, alkaline earth metal cations and transition metal cations.

3. The process as claimed in claim 1, wherein the polyoxometalate is selected from the group consisting of $H_3PW_{12}O_{40}$ (PW), $H_4SiW_{12}O_{40}$ (SiW) and $(NH_4)_6H_2W_{12}O_{40}$ ($H_2W$).

4. The process as claimed in claim 1, wherein the material conferring an electronic conductivity and comprising positive charges is a carbonaceous material obtained by heat treatment of a carbon at a temperature of at least 900° C.

5. The process as claimed in claim 4, further comprising the step of a carbon which is in the form of carbon black, of carbon nanotubes, of graphite, of glassy carbon, of carbon felt or of carbon nanoparticles is subjected to the heat treatment.

6. The process as claimed in claim 4, wherein the heat-treated carbon is milled, prior to stage i.

7. The process as claimed in claim 6, wherein the polyoxometalate is comilled with the heat-treated carbon.

8. The process as claimed in claim 4, wherein the solvent of stage i is an organic solvent.

9. The process as claimed in claim 4, wherein the content by weight of polyoxometalate is at least equal to the content by weight of carbon in the suspension obtained in stage i.

10. The process as claimed in claim 4, wherein the content by volume of the binder is at least 75% in the suspension obtained in stage i.

11. The process as claimed in claim 1 wherein the process further comprises the step of immersing the electrode obtained in stage iv in a solution of an inorganic acid.

12. The process as claimed in claim 1, wherein the binder is an organic binder.

13. The process as claimed in claim 12, wherein the binder is a fluoropolymer.

14. The process as claimed in claim 13, wherein:

the polyoxometalate is stable in an acidic medium and the binder is a fluoropolymer selected from the group consisting of hydrogenated sulfonated tetrafluoroethylene copolymers, or the polyoxometalate is stable in a neutral or basic medium and the binder is selected from the group consisting of nonhydrogenated sulfonated tetrafluoroethylene copolymers.

15. The process as claimed in claim 1, wherein the material conferring an electronic conductivity and comprising positive charges is a metal oxide carrying positive charges.

16. The process as claimed in claim 15, wherein the metal oxide is selected from the group consisting of partially oxidized titanium, titanium oxide $TiO_2$ in powder or bulk form, indium oxide doped with tin (ITO) or tin dioxide $SnO_2$.

17. The process as claimed in claim 15, wherein the metal oxide and the polyoxometalate are comilled prior to stage i.

18. The process as claimed in claim 15, wherein the content by weight of polyoxometalate is at least 25% greater than the content by weight of the metal oxide.

19. The process as claimed in claim 15, wherein the content by volume of the binder is at least 25% and at most 50% in the suspension obtained in stage i.

20. The process as claimed in claim 15, wherein the metal oxide is coated with a polymer comprising positive charges.

21. The process as claimed in claim 20, wherein the polymer comprising positive charges is selected from the group consisting of polyvinylpyridine, polyaniline, polythiophene, polypyrrol and poly(diallyl-dimethylammonium).

22. The process as claimed in claim 15, wherein the solvent of stage i is an acidic aqueous solution with a pH of less than or equal to 5.

* * * * *